US010611447B2

(12) United States Patent
Gasparoni et al.

(10) Patent No.: US 10,611,447 B2
(45) Date of Patent: Apr. 7, 2020

(54) AUTONOMOUS UNDERWATER SYSTEM FOR A 4D ENVIRONMENTAL MONITORING

(71) Applicant: ENI S.p.A., Rome (IT)

(72) Inventors: Francesco Gasparoni, Venice (IT); Mauro Favaretto, Salzano (IT); Tiberio Grasso, Spinea (IT)

(73) Assignee: ENI S.p.A., Rome (IT)

( * ) Notice: Subject to any disclaimer, the term of this patent is extended or adjusted under 35 U.S.C. 154(b) by 0 days.

(21) Appl. No.: 15/587,482

(22) Filed: May 5, 2017

(65) Prior Publication Data

US 2017/0240258 A1 Aug. 24, 2017

Related U.S. Application Data

(62) Division of application No. 14/117,520, filed as application No. PCT/EP2012/059072 on May 15, 2012, now Pat. No. 9,718,524.

(30) Foreign Application Priority Data

May 17, 2011 (IT) ..... MI2011A0859

(51) Int. Cl.
*B63G 8/41* (2006.01)
*B63G 8/00* (2006.01)
(Continued)

(52) U.S. Cl.
CPC ..... *B63G 8/001* (2013.01); *B63C 11/42* (2013.01); *B63C 11/52* (2013.01); *B63G 8/04* (2013.01);
(Continued)

(58) Field of Classification Search
CPC ..... B63G 8/001; B63G 2008/002; B63G 2008/004; B63G 2008/005; B63G 2008/007; B63G 2008/008; B63G 8/39
See application file for complete search history.

(56) References Cited

U.S. PATENT DOCUMENTS 5,487,350 A * 1/1996 Chace, Jr. ..... B63G 8/001 114/330
5,995,882 A 11/1999 Patterson et al.
(Continued)

FOREIGN PATENT DOCUMENTS

CN 101070092 A 11/2007
CN 101234665 A 8/2008
(Continued)

OTHER PUBLICATIONS

Combined Office Action and Search Report dated May 31, 2017 in Chinese Patent Application No. 201610006034.0 (with English translation).
(Continued)

*Primary Examiner* — Andrew Polay
(74) *Attorney, Agent, or Firm* — Oblon, McClelland, Maier & Neustadt, L.L.P.

(57) ABSTRACT

An autonomous underwater system for environmental monitoring including a multidisciplinary underwater station including onboard instrumentation, at least one autonomous modular underwater vehicle movable inside an area to be monitored along an assigned route, and at least one external instrumental modulus which can be connected the vehicle, wherein the multidisciplinary underwater station includes a docking area, an interface system, an equipping system for supplying the vehicle with instrumental moduli, and a management system.

16 Claims, 5 Drawing Sheets

(51) Int. Cl.

| | |
|---|---|
| ***B63C 11/52*** | (2006.01) |
| ***B63C 11/42*** | (2006.01) |
| ***B63G 8/16*** | (2006.01) |
| ***B63G 8/04*** | (2006.01) |
| ***B63G 8/08*** | (2006.01) |

(52) U.S. Cl.
CPC ..... *B63G 8/08* (2013.01); *B63G 8/16* (2013.01); *B63B 2755/00* (2013.01); *B63G 2008/004* (2013.01); *B63G 2008/005* (2013.01); *B63G 2008/008* (2013.01)

(56) References Cited

U.S. PATENT DOCUMENTS

| | | | | |
|---|---|---|---|---|
| 6,167,831 | B1 * | 1/2001 | Watt | B63G 8/001 114/245 |
| 6,362,875 | B1 | 3/2002 | Burkley | |
| 6,807,921 | B2 * | 10/2004 | Huntsman | B63G 8/08 114/312 |
| 6,854,410 | B1 * | 2/2005 | King | B63G 8/001 114/244 |
| 7,194,975 | B2 | 3/2007 | Potter | |
| 7,632,043 | B2 | 12/2009 | Thompson | |
| 7,926,438 | B2 | 4/2011 | Guerrero | |
| 2008/0144442 | A1 | 6/2008 | Combee | |
| 2008/0264323 | A1 * | 10/2008 | Gosling | B63G 8/08 114/330 |
| 2009/0095209 | A1 | 4/2009 | Jamieson | |
| 2009/0114140 | A1 | 5/2009 | Guerrero et al. | |
| 2010/0185348 | A1 * | 7/2010 | Webb | G01C 13/002 701/21 |

FOREIGN PATENT DOCUMENTS

| | | | |
|---|---|---|---|
| CN | 101436074 | A | 5/2009 |
| DE | 31 28 267 | A1 | 2/1983 |
| RU | 2 191 135 | C2 | 10/2002 |
| RU | 56325 | U1 | 9/2006 |
| RU | 2387570 | C1 | 4/2010 |
| RU | 102350 | U1 | 2/2011 |
| WO | WO 01/81168 | A1 | 11/2001 |
| WO | WO 03/059734 | A1 | 7/2003 |

OTHER PUBLICATIONS

International Search Report and Written Opinion dated Mar. 28, 2013 in Application No. PCT/EP2012/059072.

Office Acticn dated Dec. 3, 2013 in the corresponding Kazakhstan Patent Application No. 2013/1671.1 (with English Translation).

Combined Office Action and Search Report dated Jan. 27, 2016 in Chinese Patent Application No. 201280023873.3 (with English language translation).

Office Action dated Mar. 17, 2016, in Russian Patent Application No. 2013153205/11(083085) (with Engiish-language Translation).

* cited by examiner

AUTONOMOUS UNDERWATER SYSTEM FOR A 4D ENVIRONMENTAL MONITORING

CROSS REFERENCE TO RELATED APPLICATIONS

The present application is a divisional of U.S. patent application Ser. No. 14/117,520, filed on Nov. 13, 2013, the entire content of which is hereby incorporated by reference in its entirety, which was the National Stage of International Application No. PCT/EP2012/059072, filed on May 15, 2012, which claimed priority to Italian Application No. MI2011A 000859 filed on May 17, 2011.

The present invention relates to an autonomous underwater system for continuous, in-situ, long-term and wide-range environmental monitoring, in particular for measuring environmental parameters close to the seabed and alone the water column.

Surveying environmental parameters in an underwater environment represents a particularly important activity, above all close to risk areas such as oil extraction areas.

In order to perform environmental monitoring in the sea, periodical measurement campaigns are traditionally effected, with the deployment of instruments and collection of samples for subsequent laboratory analyses. This approach is clearly insufficient for guaranteeing a complete understanding of the dynamics of phenomena underway and is not capable to detect the occurrence of anomalous events in useful time.

When a continuous observation capacity is required, permanent underwater observatories are used which, by means of suitable instrumentations, collect data on the surrounding environment.

This accurate approach is useful for the monitoring of parameters relating to long-term environmental phenomena such as earthquakes, tsunamis, volcanism, but which cannot be easily used for wide-range monitoring.

In order to overcome this drawback, autonomous underwater vehicles, known in the state of the art as AUVs (Autonomous Underwater Vehicle) being increasingly used.

These vehicles are generally equipped with propulsion and driving systems for underwater movement, and various measurement instruments for collecting data relating to the underwater environment.

If suitably programmed, AUVs allow underwater explorations on predefined areas without human intervention for several hours.

The duration of these explorative campaigns, however, is influenced by the degree of energy autonomy of the vehicle which, at the end of each survey, must reach a base to download the information collected and recharge the energy reserves.

These bases or stations are generally situated on the surface to facilitate human operations, in particular for a simpler management of data parking, reconfiguration and recharging of the vehicles.

Underwater stations are also known in the state of the art, which allow the vehicle to be managed in an underwater environment.

In particular, these stations allow the energy recharging of the vehicle, reconfiguration of the same for the subsequent survey and uploading downloading of the data collected by the instruments present onboard.

This technique has led to an improvement in the degree of autonomy of the vehicles which can therefore continue to explore the seabed for a theoretical indefinite period of time.

Patent application US 2009/0095209 describes an underwater station equipped with means for receiving an AUV, charging its batteries and exchanging information with it.

This solution allows long explorations completely handled in an underwater environment.

A further example of an underwater station for AUVs is represented, in patent application US 2009/0114140 which describes a system for supporting underwater operations. This system allows the handling of an AUV, ROV (Remotely Operated Vehicle) and HROV (Hybrid Remotely Operated Vehicle) from an energy, communication and maintenance point of view.

In particular, when these vehicles enter into contact with this system, they can receive energy for explorations, exchange information, i.e. the data collected by the instruments onboard, and undergo maintenance.

This system, however, as also the current techniques known in the art, do not allow the explorative mission of the vehicle to be adapted to the specific requirements of the moment, and in particular they do not allow the reconfiguration of the instrumental equipment of the vehicle in an underwater environment.

This aspect requires that, for each type of exploration, vehicles must be equipped a priori and ad hoc.

This lack of flexibility of the methods and systems known in the art, limits the autonomy of use of current explorative solutions in an underwater environment.

The Applicant has found that by using underwater stations for energy recharging and exchange of communications with these vehicles, the necessity of creating independent and autonomous systems capable of effecting long-term and wide-range underwater explorative campaigns, can only be partly satisfied.

In the state of the art, the use is also known of autonomous underwater vehicles constructed according to modula which allow a certain set-up flexibility of the vehicle. This technique allows to achieve AUVs which are suitable to meet various operative requirements. Patent application WO 03/059734, for example, describes an AUV constructed with mechanical modula which, when combined with each other, form an AUV which satisfies the specific explorative requirements of the moment.

In this case, the assembly of the various modula forming the AUV is effected manually in the open air and not in an underwater environment.

With the autonomous underwater vehicles currently known, a timely and autonomous modulability of AUVs directly in an underwater environment, is not possible. The necessity of re-emerging the AUV from the depths to be able to add or modify the instruments onboard, represents a considerable waste of time, which greatly limits the operative flexibility of these systems.

The Applicant has therefore conceived an autonomous underwater vehicle capable of housing one or more external instrumental modules that can be interchanged directly onsite and without requiring the manual intervention of an operator, thus allowing a complete adaptability of the means to the specific explorative requirements of the moment. It is to be understood that the terms modulus and module may be used interchangeably throughout the specification.

An objective of the present invention is to overcome the drawbacks mentioned above and in particular to provide an autonomous underwater system for effecting long-term monitoring, in continuous, onsite and with a wide range of parameters relating to the marine environment, consisting of a multidisciplinary underwater station and at least one autonomous underwater vehicle, cooperating with each other to allow various kinds of environmental explorations. In particular, for monitoring the environmental impact of offshore activities, characterizing unexplored sites, supporting the management of polluted areas, monitoring the integrity of structures installed in underwater environments and verifying the possible intrusion of third-parties in an area to be monitored.

A further objective of the present invention is to provide an autonomous underwater vehicle for various kinds of environmental explorations that can be modulated by means of external instrumental modula which can be connected to the main body of the vehicle.

Further objective of the present invention is to provide a multidisciplinary underwater station equipped with means and instruments for performing various types of environmental surveys.

Another objective of the present invention is to provide a multidisciplinary underwater station equipped with means for handling and equipping autonomous modular underwater vehicles.

Yet another objective of the present invention is to provide a method for four-dimensional environmental monitoring capable of detecting data in relation to time along the three dimensions of space.

These and other objectives of the present invention are achieved by providing an autonomous underwater system for four-dimensional environmental monitoring as specified in claims 1, 18 and 40, Further characteristics of the autonomous underwater system for four-dimensional environmental monitoring are object of the dependent claims.

The characteristics and advantages of an autonomous underwater system for four-dimensional environmental monitoring according to the present invention will appear more evident from the following illustrative and non-limiting description, referring to the enclosed schematic drawings, in which.

Figure 3A:
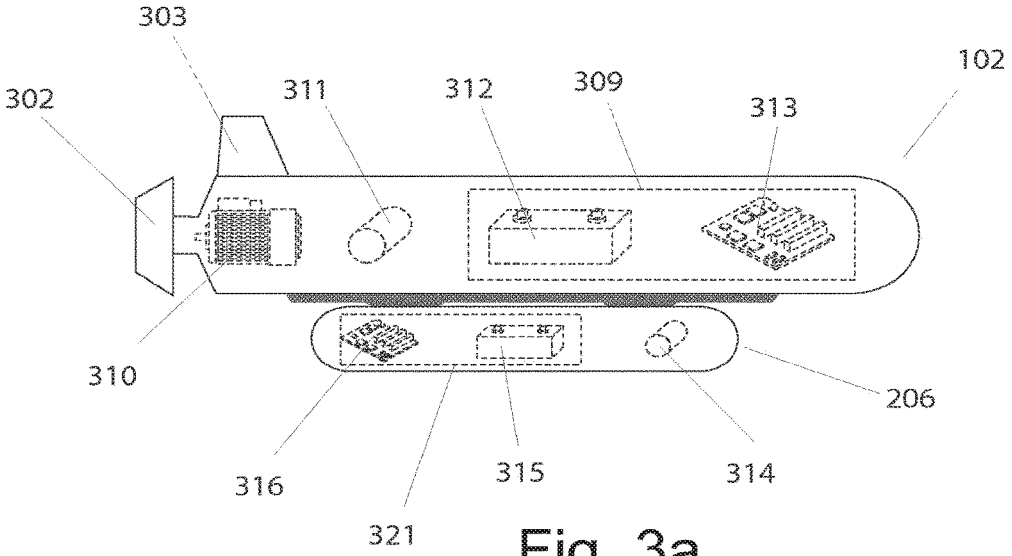
Figure 4A:
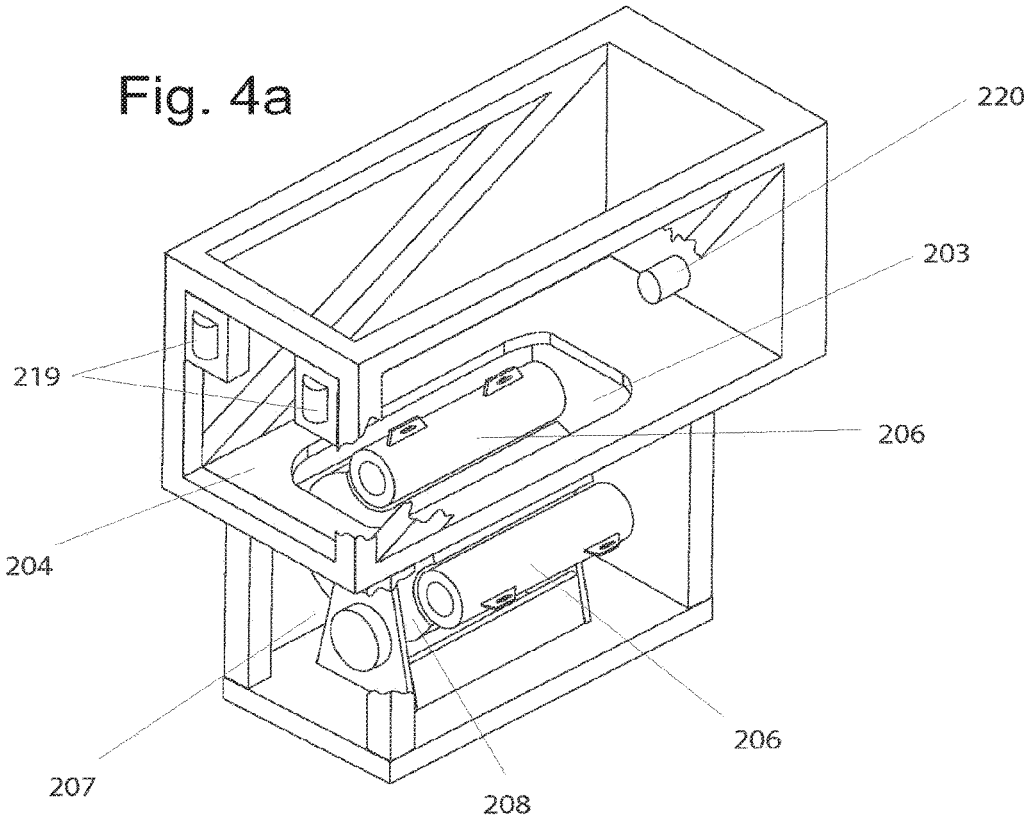
Figure 4B:
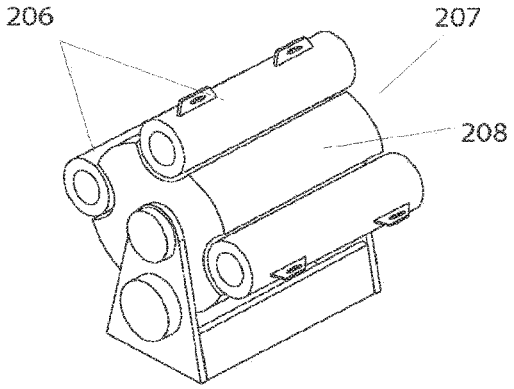
Figure 4C:
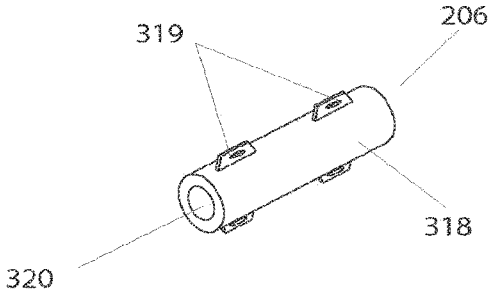
Figure 5:
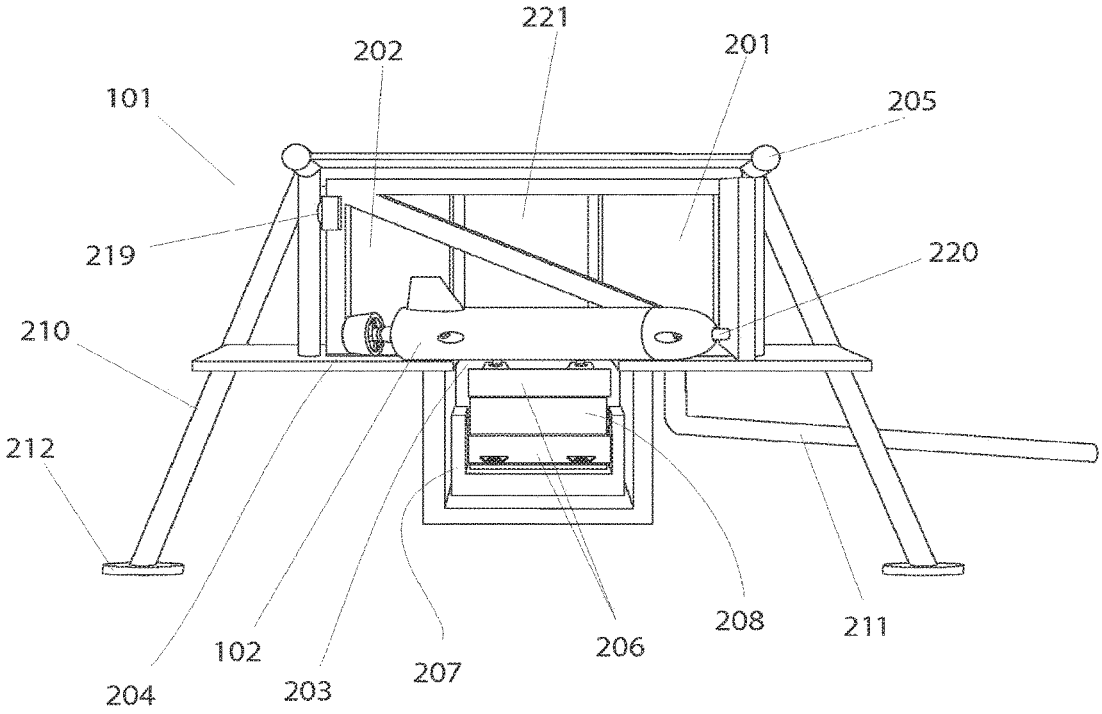

FIG. 3*a* is a schematic view of an autonomous modular underwater vehicle and an external instrumental modulus connected to it;

FIG. 5*b* is a perspective view of a preferred embodiment of the autonomous underwater vehicle that can be modulated by means of an external instrumental modulus;

FIG. 4*a* is a sectional perspective view of the equipping system of the autonomous underwater vehicle and the docking area for the same, forming part of the multidisciplinary underwater station;

FIG. 4*b* is a perspective view of the equipping system equipped with instrumental modula and forming part of the multidisciplinary underwater station;

FIG. 4*c* is a perspective view of the instrumental modulus that can be connected to the autonomous underwater vehicle;

FIG. 5 is a perspective view of a vertical section of the multidisciplinary underwater station in which an autonomous modular underwater vehicle is docked for equipping operations by means of an external instrumental modulus.

With reference to the figures, these show an autonomous underwater system for four-dimensional environmental monitoring, indicated as a whole with 100.

A first object of the present invention relates to an autonomous underwater system for environmental monitoring 100 comprising a multidisciplinary underwater station 101 equipped with onboard instrumentation 202, at least one autonomous, modular underwater vehicle 102 movable inside an area to be monitored 107 along an assigned route 106 and at least one external instrumental modulus 206 which can be connected to said vehicle 102, wherein said multidisciplinary underwater station 101 is characterized in that it comprises:

- at least one docking area 204 suitable for accommodating said vehicle 102;
- at least one interface system 220 suitable for communicating with said docked vehicle 102;
- at least one equipping system 207 suitable for providing said docked vehicle 102 with said instrumental modula 206 and comprising at least one parking area 208 suitable for the storage of said modula 206;
- at least one management system 201 suitable for managing the functionalities of said station 101.

Said area to be monitored 107 can be a generic underwater area involved in offshore activities in which there are extraction and interface infrastructures of reservoirs 103, pipelines and cables 105 connected with a surface structure 104 and whatever is normally present in an underwater area involved in oil and gas activities.

In particular, the surface structure 104 connected by means of cables and pipelines 105 with the underwater area, can be a floating platform or structure attached to the seabed.

In a preferred embodiment of the present invention, said autonomous modular underwater vehicle 102 inspects said area to be monitored 107 by moving along the assigned route 106 according to tracks pre-programmed or autonomously calculated by the same vehicle.

In particular, said assigned route 106 can consist of straight trajectories and/or curved trajectories, routes at a constant and/or variable depth, preferably ranging from 0 to 1,500 metres.

In a preferred embodiment of the present invention, said multidisciplinary underwater station 101 comprises a metallic structure 205, preferably made of an aluminium alloy, capable of resting on the sea bed by means of legs 210 having supporting feet 212.

Said structure 205 allows the physical protection from accidental events of the instrumentation onboard 202, instrumental modula 206, underwater vehicle 102 when docked in the station 101, and anything else contained in the station 101.

Said structure 205 also allows the interface system 220, the equipping system 207, the management system 201 and also the various parts inside the multidisciplinary underwater station 101, to be contained in its interior.

In a preferred embodiment of the present invention, said autonomous modular underwater vehicle 102 carries out monitoring campaigns in said area to be monitored 107, collecting data on the submarine environment and on the integrity of the infrastructures operating therein, by means of instruments installed onboard the vehicle 102 and/or by means of said external instrumental modula 206.

In a preferred embodiment of the present invention, said equipping system 207 provides said vehicle 102 with the most suitable instrumental modulus 206 for the purpose of the monitoring mission to be effected, according to the instructions received from said management system 201.

In a preferred embodiment of the present invention, said external instrumental modula 206 are kept in a parking area 208, present inside the structure 205, equipped with electromechanical instruments (not illustrated) which allow the connection/disconnection of the modula 206 from the station.

In particular, said instrumental modula 206 are stored in said parking area 208 and when connected to said parking area 208, can be recharged, configured, programmed and run by means of the management system 201.

In particular embodiment the present invention, said parking area 208 can be an automated system, preferably a revolver (FIG. 4*b*), which handles the instrumental modula 206 for loading/unloading operations from the underwater vehicle 102, on the basis of the explorative mission programmed or driven by remote control.

Once said instrumental modula 206 been disconnected from said parking area 208, they can be positioned on the underwater vehicle 102 by means of electromechanical means (not illustrated) present in the equipping system 207.

In a preferred embodiment of the present invention, said multidisciplinary underwater station 101 comprises onboard instrumentation 202, which can be fixed 209 or movable 213, suitable for measuring at least one of the following parameters:

- temperature;
- electric conductivity;
- concentration and/or saturation percentage of dissolved oxygen;
- turbidity;
- concentration and/or profile of the particulate in suspension;
- fluorescence (relating, for example, to chlorophyll and CDOM);
- pH;
- concentration of dissolved gases (for example $CH_4$, $H_2S$, $CO_2$);
- concentration of hydrocarbons (for example PAH);
- concentration of nutrients (for example, nitrates, phosphates, silicates, ammonia);
- concentration of trace metals;
- velocity profile and direction of the sea current;
- height and direction of the waves;
- tide level;
- sound wave pressure (for example acoustic monitoring of the presence and passage of marine species such as cetaceans by means of hydrophones);
- biological responses of living organisms (for example the opening/closing frequency of the clams of specifically instrumented molluscs).

In a preferred embodiment of the present invention, said fixed onboard instrumentation 209 is fully contained inside a structure 205, and comprises at least one sensor 214 and at least one local control unit 215 suitable for managing all the functionalities the sensors, for example acquisition, power, control, etc.

In a preferred embodiment of the present invention, said movable onboard instrumentation 213 is different with respect to the fixed onboard instrumentation 209 in that it can move the measurement instrumentation away from the station 101 thanks to a floating unit 217, containing in its interior at least one sensor and a cable 218 which prevents its disconnection from the station 101.

Said cable 218, when wound by the action of a winch 216, allows the floating unit 217 equipped with sensors to be returned inside the station 101 for interface activities with the station 101 itself.

This vertical movement of the floating unit 217 allows the profiling of the water column, revealing, by means of the sensors contained therein, data on the underwater environment at different heights from the sea bottom.

In a preferred embodiment of the present invention said multidisciplinary underwater station 101 comprises, inside said structure 205 a management system 201 suitable for managing the functionalities of the station, in particular the communication between the various instrumentations onboard, the interface with a surface structure 104, the distribution and regulation of the electric feeding, the monitoring of the technical parameters of the system (status, alarms, etc.), the collection and storage of the data obtained by the various instruments, the configuration and selection of the external instrumental modula 206 and the programming of the monitoring missions.

In particular, said management system 201 can be connected with a surface structure 104 by means of at least one umbilical cable 211, which allows the transmission of data and/or energy feeding of the station 101.

In a preferred embodiment of the present invention, said multidisciplinary underwater station 101 comprises, inside said structure 205, a docking area 204 suitable for allowing the entrance/exit and temporary docking of the vehicle 102 inside the underwater station 101.

The entrance and exit of the vehicle 102 in this docking area 204 are facilitated by suitable guiding devices, selected from: acoustic positioning systems, television cameras, lights, proximity sensors 219, entrance bulkheads.

In particular, said guiding devices forming part of said docking area 204, can be connected to the management system 201.

Preferably, said docking area 204 may comprise a horizontal plane on which the vehicle 102 rests after entering the station 101, and an opening 203 in the horizontal plane through which the equipping system 207 connects the instrumental modula 206 to the docked vehicle 102.

It should be Pointed out that when the autonomous modular underwater vehicle 102 is positioned in the docking area 204, said interface system 220 of said station allows at least one of the following operations to be effected:

- data communication between vehicle 102 and station 101;
- recharging of the batteries 312 of the vehicle 102.

In a preferred embodiment of the present invention, said interface system 220 consists of direct connection means such as connection sockets or contact elements.

In an alternative embodiment, said interface system 220 between said station 101 and said vehicle 102 consists of wireless communication means.

In this particular solution, the batteries 312 of said vehicle 102 can be recharged by means of electromagnetic induction systems.

It should be pointed out that these induction systems are known in the art and available to experts in the field without imposing additional constraints with respect to normal routine work.

A second object of the present invention relates to an autonomous modular underwater vehicle 102 equipped with onboard measurement sensors 311, comprising at least one main thruster 302, at least one auxiliary thruster for fine positioning 305, 306, 307, a hull 301, at least one electronic control modulus 313, at least one energy reserve 312, al least one connection system 308, characterized in that it comprises means 317 for attaching at least one instrumental external modulus 206, wherein said instrumental external modulus 206 is equipped with at least one measuring sensor 314.

In a preferred embodiment of the present invention, said main thrusters 302 and fine positioning thrusters 305, 306, 307 have a propeller and are operated by at least one motor 310 inside the hull 301, said motor 310 is preferably electric.

In particular, the side thrusters 305, front thrusters 306 and upper/lower thrusters 307 serve for a fine displacement of the vehicle 102 in space, giving this a wide manoeuvring and positioning capability.

The manoeuvring of the vehicle 102 can be further facilitated by one or more rudders 303.

In a preferred embodiment of the present invention, said hull 301 is made of a non-corrodible material, preferably a composite material.

The internal components which must operate in air, such as the electronic control modulus 313 and the energy reserve 312, are housed in one or more watertight containers 309 preferably made of titanium and capable of tolerating high pressures, preferably up to 300 bar.

In a preferred embodiment of the present invention, said onboard measuring sensors 311 effect measurements of at least one of the following parameters:

temperature;
electric conductivity;
saturation concentration and/or percentage of dissolved oxygen;
turbidity;
fluorescence (relating to chlorophyll and/or CDOM);
pH;
dissolved gas concentration (for example $CH_4$, $H_2S$, $CO_2$);
hydrocarbon concentration (for example PAH).

In particular, said onboard measuring sensors 311 positioned inside the hull 301 can get in contact with seawater by means of one or more openings 304 present on the hull 301 itself.

In a preferred embodiment of the present invention, said attaching means 317 may be means activated electromechanically and allow the hooking of the modulus 206 to the vehicle 102.

Said vehicle 102 can comprise communication means (not illustrated) with the external instrumental modulus 206, allowing a bidirectional exchange of information for synchronizing the data collected by the various sensors, in addition to a possible energy exchange.

In a preferred embodiment of the present invention, said autonomous underwater modular vehicle 102 comprises a connection system 308 capable of being interfaced with an interface system 220 for the exchange of communications between the vehicle 102 and the underwater station 101. Said connection system 308 also allows the recharging of the energy reserves on board 312.

In a preferred embodiment, of the present invention, said autonomous underwater modular vehicle 102 can comprise an electronic control modulus 313 which manages the functioning and control of the thrusters, the sensors 311 onboard, the energy reserves 312, the attaching means 317, the connection system 308 and possible communication means with the external instrumental modulus 206.

In a particular embodiment of the present invention, said energy reserve 312 is an electric battery, preferably a lithium ion or lithium polymer battery.

It should be pointed out that the vehicle can be produced with a hull 301 having a flattened form and in particular with a flat lower surface in order to facilitate the resting of the vehicle 102 on the multidisciplinary underwater station 101 or on the seabed In particular, when the vehicle 102 approaches the station 101, the lower surface of the hull 301 can easily rest on the surface of the docking area 204, allowing the equipping system 207 to intervene on the vehicle through the opening of 203 of the surface.

In a preferred embodiment of the present invention, said external instrumental modulus 206 equipped with measuring sensors 314 may comprise:

connection means 319;
communication means 320;
a hull 318;
a control unit 316.

In a particular embodiment of the present invention, said external instrumental modulus 206 comprises at least an inner energy source 315, preferably an electric battery.

In a preferred embodiment of the present invention, the control unit 316 and energy source 315 can be contained in one or more watertight containers 321 positioned inside the hull 318 and capable of tolerating high underwater pressures.

Said watertight container 321 is preferably made of titanium.

It should be pointed out that said control unit 316, said sensors 314 and said internal energy source 315 are contained inside said hull 318 for a better protection from possible impact and to ensure that the vehicle has an adequate hydrodynamicity. Said hull 318 is preferably made of a composite material or another non-corrodible material.

In a preferred embodiment of the present invention, said connection means 319 allow the hooking of the instrumental modulus 206 to the equipping system 207 of the underwater multidisciplinary station 101 or to the vehicle 102, guaranteeing an integral coupling during the displacement of the vehicle 102 in the water.

In particular embodiment of the present invention, said connection means 319 can be mechanical or electromechanical driven by said control unit 316 or consisting of suitably shaped grooves present on the hull 318.

In a preferred embodiment of the present invention, said communication means 320 allow the exchange of information and/or the supply of energy with external structures such as the vehicle 102 or the equipping system 207 of the multidisciplinary underwater station 101.

In a particular embodiment of the present invention, said communication means 320 allow the synchronization of the measurements effected by the sensors 314 with those effected by the sensors 311 onboard said vehicle 102.

In a preferred embodiment of the present invention, said control unit 316 controls the functioning of the measuring sensors 314, the regulation and distribution of the energy feed and the interface with the vehicle 102.

In a preferred embodiment of the present invention, said measuring sensor 314 installed in said external instrumental modulus 206 can be selected from the following types of sensors:

optical (photocameras, videocameras);
acoustic (sonars, echo-sounders);
automatic hydrocarbon analyzer;
automatic phenol analyzer;
automatic analyzer of trace metals;
automatic analyzer of nutrients.

A third object of the present invention relates to a 4D environmental monitoring method, in an underwater environment, comprising a multidisciplinary underwater station 101, according to the present invention, at least one external instrumental modulus 206, according to the present invention, and at least one autonomous modular underwater vehicle 102, according to the present invention, characterized by the following phases:

- selection and supply of at least one external instrumental modulus 206 to the autonomous modular underwater vehicle 102 by the multidisciplinary underwater station 101;
- attaching of the external instrumental modulus 206 to the autonomous modular underwater vehicle 102;
- departure of the autonomous modular underwater vehicle 102 and the external instrumental modulus 206 attached to it, from the multidisciplinary underwater station 101;
- execution of the survey by the autonomous modular underwater vehicle 102 and external instrumental modulus 206 attached to it, along a trajectory predefined or calculated in real time on the basis of data measured by the sensors;
- execution of measurements and data collection on the underwater environment by the sensors present in the autonomous underwater vehicle 102 and in the external instrumental modulus 206 attached to it.
- return of the autonomous modular underwater vehicle 102 to the multidisciplinary underwater station 101;
- download of data collected data by the underwater multidisciplinary station 101;
- recharging of the batteries of the autonomous modular underwater vehicle 102 by the multidisciplinary underwater station 101;
- docking of the autonomous modular underwater vehicle 102 inside the multidisciplinary underwater station 101 until the subsequent mission;
- measurement and data collection on the underwater environment by the instrumentation 202 onboard the multidisciplinary underwater station 101;
- processing of the combination of data collected by the autonomous modular underwater vehicle 102, the external instrumental modulus 206 and the instrumentation onboard 202 for the analysis of the underwater environment.

In a preferred embodiment of the present invention, said method allows environmental monitoring by correlating data collected at the moment of detection and the survey position.

In a preferred embodiment of the present invention, said data collected represent measurements of at least one of the following parameters:

- temperature;
- electric conductivity;
- saturation concentration and/or percentage of the oxygen dissolved;
- turbidity;
- concentration and/or profile of the particulate in suspension;
- fluorescence (relating for example to chlorophyll and CDOM);
- pH;
- concentration of dissolved gases (for example $CH_4$, $H_2S$, $CO_2$);
- hydrocarbon concentration;
- nutrients concentration;
- concentration of trace metals;
- phenol concentration;
- velocity profile and direction of the sea current;
- height and direction of the waves;
- tide level;
- sound wave pressure (for example for the acoustic monitoring of the presence and passage of marine species such as cetaceans by means of hydrophones);
- biological responses of living organisms (for example the opening/closing frequency of the clams of specifically instrumented molluscs);
- optical and/or acoustic images, for example of the seabed and infrastructures being inspected.

In a preferred embodiment of the present invention, said trajectory selected can be autonomously identified by the management system 201 on the basis of pre-formulated maps or on the basis of processings effected in real time on the data collected, or, alternatively, it is imposed by a surface system (not illustrated) connected with the station 101.

In a preferred embodiment of the present invention, said data collected in relation to time provide, after processing, an overall vision, i.e. a four-dimensional vision, of the underwater environment monitored.

EXAMPLE

Figure 1:
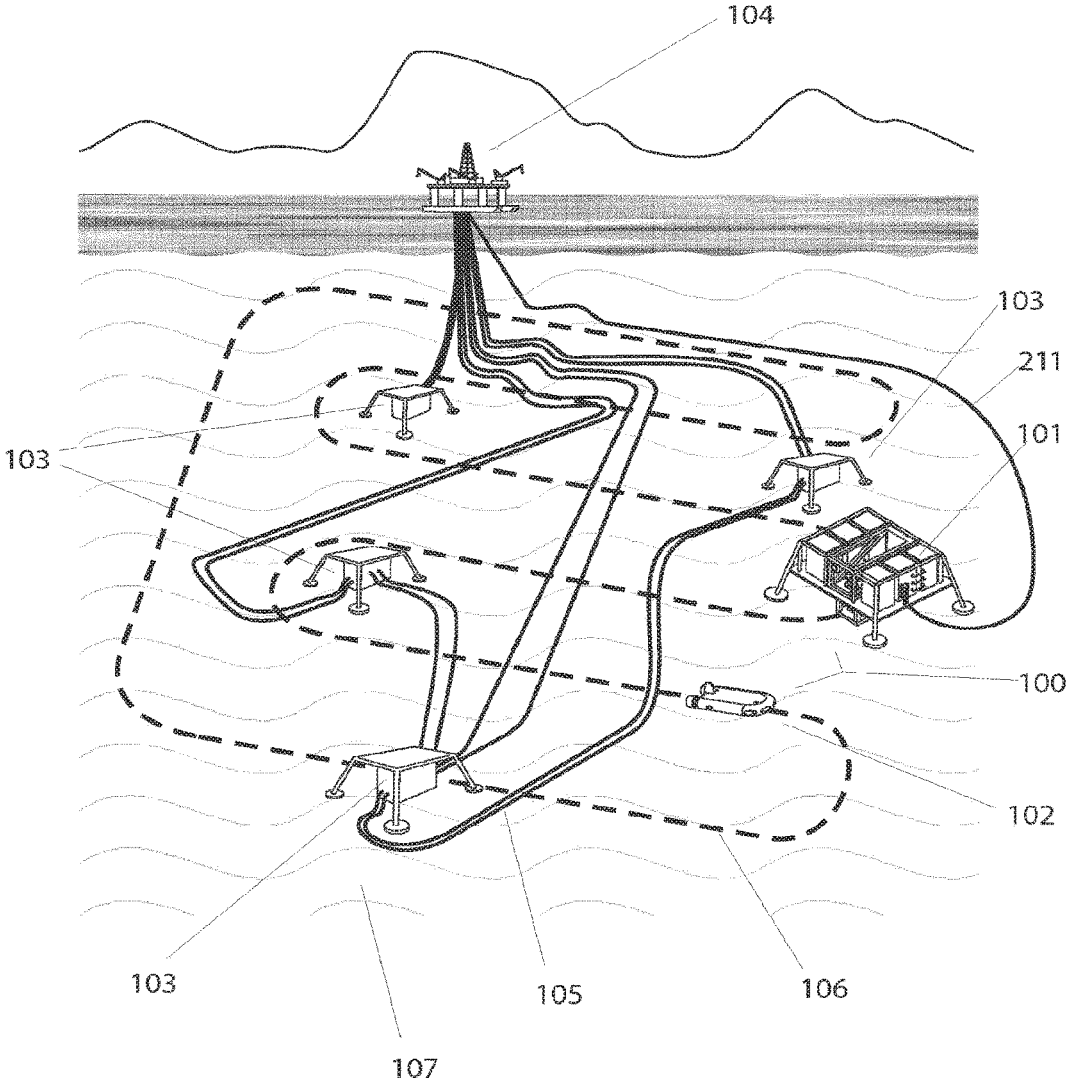
FIG. 1 is a schematic view of a preferred embodiment of an autonomous underwater system for four-dimensional environmental monitoring according to the present invention.

An autonomous underwater system 100 was used for the purpose, positioned inside an area 107 involved in oil&gas activities, situated on the seabed according to FIG. 1, in which an autonomous modular underwater vehicle 102 moves along a route 106 defined a priori on the basis of the positioning of the infrastructures 103 and pipelines 105 that connect said infrastructures with the platform situated on the surface 104.

During the explorative mission 106, the autonomous modular underwater vehicle 102 acquires data relating to the sea environment and integrity of the infrastructures operating therein by means of the sensors installed onboard and/or present on the instrumental modulus 206, returning, at the end of the mission, to the multidisciplinary underwater station 101 positioned on the seabed.

In particular, the area to be monitored with said autonomous underwater system 100 extends for about 4 km in width and 4 km in length and is situated at a depth of about 1000 metres.

Figure 2:
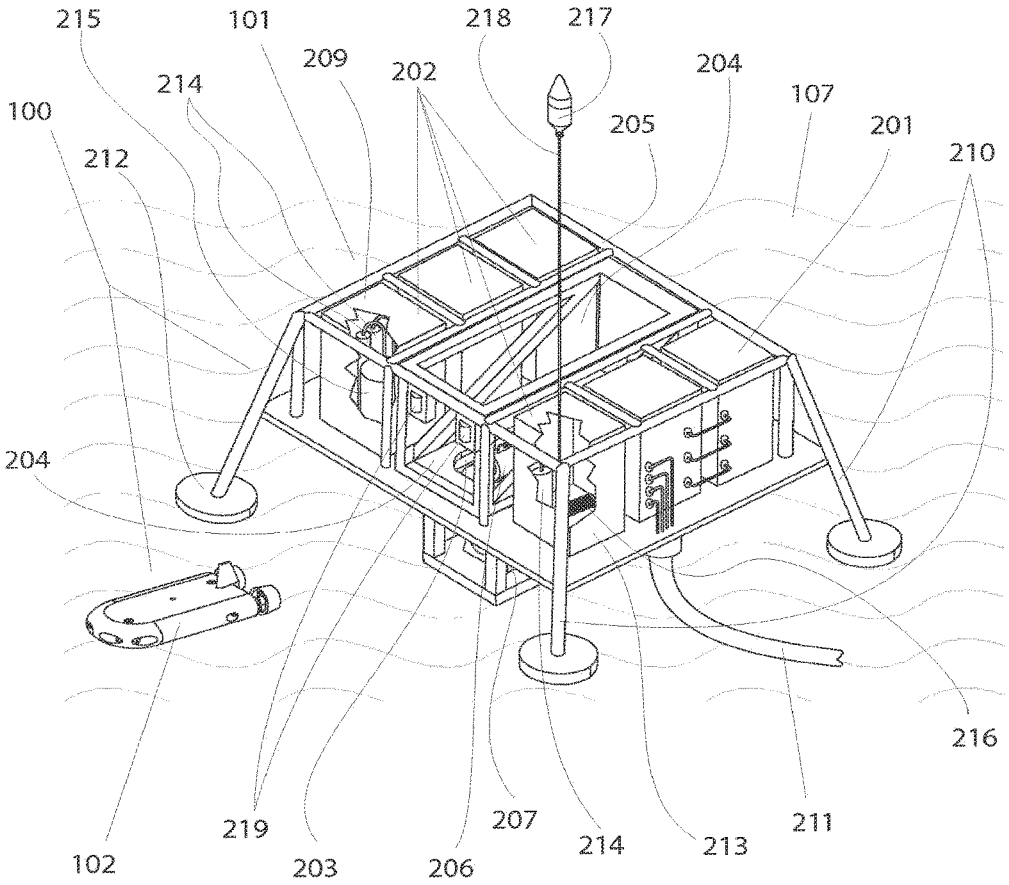
FIG. 2 is a perspective view of a preferred embodiment of the multidisciplinary underwater station positioned on the sea bottom.

The multidisciplinary underwater station 101 includes a metal structure 205 according to FIG. 2, which is firmly positioned on the seabed thanks four supporting legs 210 provided with the same number of supporting feet 212.

Various systems necessary for the functioning of the station are positioned inside said structure 205, which has a base of 5×5 metres and a height of 3.5 metres. In particular, the station comprises a control system 201 which communicates, by means of an umbilical cable 211, with the floating platform 104.

This control system 201 sends information on the monitoring missions effected and receives information on the configuration of future missions.

The control system 201 also handles the distribution and regulation of the electric power received through the umbilical cable 211 from the surface structure.

The control system 201 also manages communication with the various onboard instrumentations, collecting the data measured and storing them before processing.

Said control system 201 also guarantees control of the various technical parameters of the system (status, alarms, etc.).

The station 101 contains in its interior two types of onboard instrumentation 202, of the fixed type 209 and movable type 213, which allow the measurement of various parameters of the underwater environment.

Some of the sensors used for the instrumentation onboard are indicated hereunder.

A conductivity, temperature and depth sensor for measuring the temperature, electric conductivity and parameters deriving therefrom (salinity, density, sound velocity). In particular, a CTD SBE-16 sensor of the company Seabird Electronics was used.

An optical type sensor for measuring the saturation concentration and/or percentage of the oxygen dissolved. In particular, a sensor model 4330F of the company AADI was used.

A sensor for measuring the turbidity by means of wavelengths in the blue zone. In particular, a sensor model ECO-NTU of the company WETLABS was used.

A sensor for the concentration and/or profile of the suspended particulate of the high-frequency acoustic type. In particular, a sensor model AQUAscat 1000 of the company Aquatec was used.

A fluorometer for measuring the fluorescence, for example of chlorophyll and CDOM. In particular, a fluorometer model ECO FL the company WETLABS was used.

A pH measurement sensor. In particular, a sensor model SBE-27 of the company Seabird Electronics was A sensor for measuring the concentration of dissolved methane. In particular, a sensor model METS of the company Franatec was used.

A sensor for measuring the hydrocarbon concentration was used. In particular, a sensor model HydroC of the company Contros was used.

A sensor for measuring the concentration of nutrients: nitrates, phosphates, silicates, ammonia. In particular, an onsite sensor nutrients model NAS3-X of the company Envirotech Instruments was used.

A sensor for measuring the concentration of trace metals such as Cu, Pb, Cd, In, Mn and Fe. In particular, an underwater voltammetric probe model VIP of the company Idronaut was used.

A sensor for measuring the velocity profile and direction of the sea current. In particular, a sensor Acoustic Doppler Current. Profiler model Workhorse Monitor ADCP of the company RD Instruments was used.

A sensor for measuring the tide level. In particular, a high-pressure depth sensor of the series 8CB of the company Paroscientific was used.

A sensor for measuring the acoustic wave pressure. In particular, a hydrophone model TC-4042 of the company RESON was used.

A sensor for measuring the biological responses of molluscs. In particular a system developed by the company Biota Guard was used.

As far as the movable instrumentation 213 is concerned, this comprises a floating unit 217 made of a composite material, containing one or more measurement sensors. As the casing 217 is buoyant in water, it allows profiling along the water column.

Once these operations have been effected, an electric winch 216 rewinds the cable 216 which connects the floating unit 217 to the station 101, repositioning the movable instrumentation 213 inside the structure 205.

The fixed instrumentation 209, on the contrary, is firmly constrained to the structure 205, but can be substituted in the case of necessity by means of normal underwater intervention using a ROV equipped with an adequate manipulating arm.

The station 101 contains inside the structure, a docking area 204, according to FIGS. 2, 4*a* and 5, comprising a horizontal plane having indicative dimensions of 4,000×2,000 mm capable of easily housing the autonomous modular underwater vehicle 102.

Said docking area 204 also includes some instruments which operate to support the vehicle 102 to facilitate its positioning inside the station 101. In particular, some acoustic positioning systems and proximity sensors 219 are installed in the docking area 204, which detect the approaching of the vehicle 102 towards the area in question.

The docking area 204 also has an opening 203 in the horizontal supporting plane through which the external instrumental module 206 are installed on the vehicle 102.

On entering station 101, the vehicle 102 is positioned on the plane of the docking area 204 in a particular position which allows the equipping system 207 to easily operate on the vehicle 102, through the opening the plane 203, for the parking and substitution of the external instrumental modulus 206.

In particular, the equipping system 207 positions the instrumental modulus 206 detached from the vehicle 102 inside the parking area 208 and receives instructions from the control system 201 for removing a new external instrumental modulus 206 to be positioned on the vehicle 102.

All the external instrumental modula 206 available are contained inside the parking area 208, and in particular they are contained in a carousel system which, by rotating, facilitates the removal of the modulus 206 preselected for the monitoring mission to be effected; the remaining modula 206 remain connected to the carousel for the recharging and configuration operations.

Once the instrumental modulus 206 has been removed, the equipping system 207 brings the instrumental modulus in correspondence with the attaching means 317 present underneath the vehicle 102 and then effects the connecting operation of the external modulus 206 to the vehicle 102.

The external instrumental modulus 206 used, has connection means 319 which protrude with respect to the hull 318, as shown in FIG. 4*c*.

These connection means 319 allow the modulus to be connected to both the equipping system 207 and to the attaching means 317 of the vehicle.

In particular, the hull 318 of the external instrumental modulus 206 is made of a composite material.

The components inside the modulus which must operate in air, such as the control unit 316 and the internal energy source 315, are contained in a watertight container 321 capable of tolerating high pressures.

The external instrumental modulus 206 has cylindrical form with flat ends and in some configurations reaches 1,500 mm in length and 250 m in diameter.

When the modulus 206 has been correctly positioned by the equipping system 207, the attaching means 317 block the external instrumental modulus 206 to the vehicle 102.

Only subsequently the modulus 206 is released by the electromechanical means of the equipping system 207, returning to rest position.

The instrumental modulus 206 also has a suitable connection, which acts as a communication means 320 for the exchange of information and data with the vehicle 102 or with the underwater station 101.

This connection allows the exchange of information at the input and output with the modulus 206.

In particular, when the modulus 206 is connected to the vehicle 102 by the attaching means 317, the communication means 320 comes into contact with the connection means (not illustrated) of the autonomous modular underwater vehicle 102, The instruments 311 and 314 are synchronized through this connection so as to obtain a univocal measurement in relation to the time.

Figure 3B:
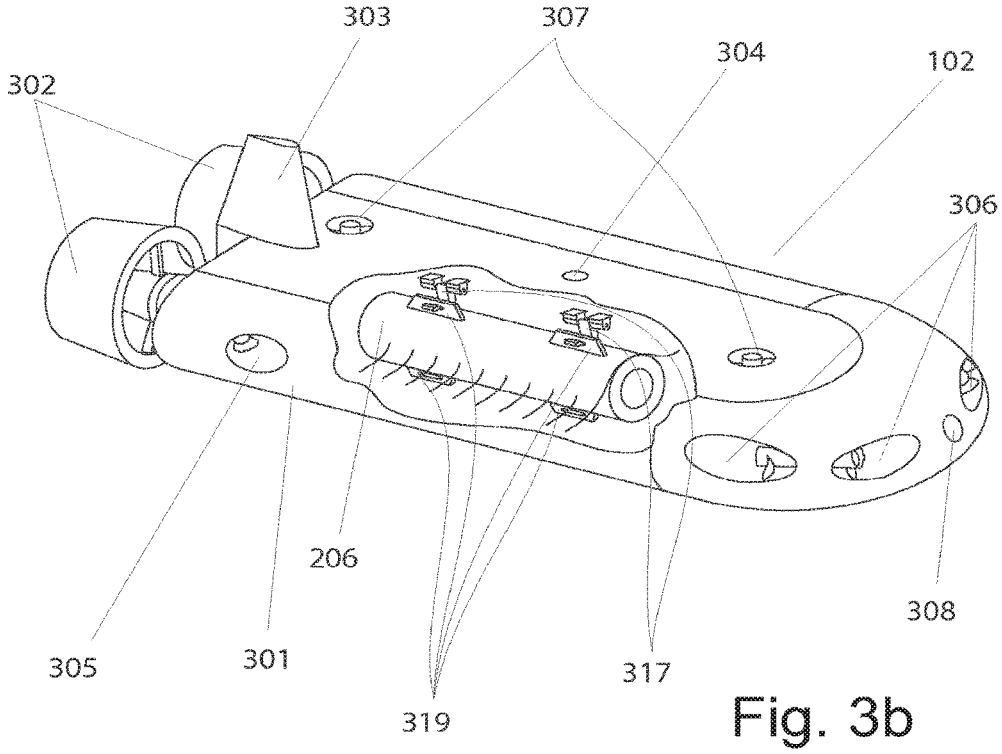

The autonomous modular underwater vehicle 102 used has a hull 301 having a flattened form to provide a better support on the seabed and on the plane 204 of the station 101 and includes a series of thrusters which allow the means to be moved in three dimensions (FIG. 3*b*). In particular, there are two main thrusters 302 positioned at the stern of the vehicle 102, whereas there are two rear 305 and four front 306 auxiliary side thrusters which are positioned on the two sides of the vehicle 102. Finally, there are two upper and lower auxiliary thrusters 307 for each side, positioned at the prow and stern of the vehicle 102. All the thrusters are activated by electric motors.

The combination of all the thrusters gives the vehicle the maximum flexibility of movement and positioning in space and also the possibility of horizontally stabilizing the vehicle 102 while running.

The thrusters are fed with rechargeable lithium ion batteries 312 capable of guaranteeing at least 8 hours of autonomy.

The rudder 303 also facilitates the manoeuvring and establishment of the trajectories to be followed during the monitoring explorations 106.

The onboard sensors 311 of the vehicle 102 get in direct contact with seawater by means of the openings 304 present on the hull 301.

The vehicle 102 reaches the following dimensions: 3,750×1,500×750 mm (length×width×height).

The onboard sensors 311 of the vehicle 102 and the measurement sensors 314 of the external instrumental modulus 206 allow numerous parameters to be measured in relation to the time and position. In particular the vehicle is equipped with onboard instrumentation for measuring the following parameters:

- temperature, electric conductivity and pressure, by means of the probe CTD SBE-49 of SeaBird, turbidity by means of the sensor ECO NTU of WETLABS,
- fluorescence for chlorophyll and CDOM by means of the sensor ECO FL of WETLABS,
- concentration of dissolved oxygen and saturation percentage by means of the sensor 4330F of AADI,
- volumetric concentration of PAH hydrocarbons by means of the sensor HydroC of CONTROS.

The external instrumental modulus 206 connectable to the vehicle and selectable, depending on the mission program, envisages the following solutions:

- water sampling modulus, equipped with the automatic sampler Aqua Monitor of the company Envirotech Instruments,
- Observation modulus, to be used for leakage detection or for the visual inspection of underwater infrastructures such as, for example, flowlines, manifolds, PLEMS etc. It is equipped with instruments for monitoring the following parameters data:
  - images and videos revealed by means of high-resolution colour videocameras INSPECTOR HD produced by the company ROS (Remote Ocean Systems);
  - methane concentration revealed by means of the sensor METS of the company Franatech;
  - volumetric concentration of PAH hydrocarbons revealed by means of the sensor HydroC of the company CONTROS;
  - the presence of dye tracers revealed by means of the optical measurement system Bowtech using a LED-540 lamp and a monochromatic telecamera 600TVL.
- Polluttant analysis modulus, for the in-situ measurement of the following parameters:
  - concentration of trace metals by means of the probe VIP of the company Idronaut;
  - concentration of specific hydrocarbons by means of one or more analyzers;
  - concentration of phenols by means of an analyzer;
  - concentration of nutrients by means of the sensor NAS3-X of the company Envirotech Instruments.
- Acoustic surveys modulus using the synthetic opening sonar Prosas Surveyor produced by Applied Signal Technology Inc.

Finally, it is clear that the system thus conceived can undergo numerous modifications and variants, all included in the invention; furthermore, all the details can be substituted by technically equivalent elements. In practice, the materials used, as also the dimensions, can vary according to technical requirements.

The invention claimed is:

1. An autonomous modular underwater vehicle including onboard measuring sensors, comprising:

- at least one main thruster;
- at least one auxiliary thruster for fine positioning;
- a hull;
- at least one battery;
- circuitry configured to interface with an interface for exchanging communications between the vehicle and an underwater station allowing the recharging of the at least one battery;
- at least one external instrumental module, wherein the at least one external instrumental module includes at least one measuring sensor;
- an electromechanically activated attaching coupler which allows attachment of the at least one external instrumental module to the underwater vehicle by hooking in which a coupling member of the electromechanically activated attaching coupler passes through a connection tab provided on the at least one external instrumental module; and
- at least one electronic control module implemented by circuitry and configured to manage propulsion, sensors, and power,
- wherein the electronic control module and the battery are housed in one or more watertight containers.

2. The autonomous, modular, underwater vehicle according to claim 1, wherein the at least one main thruster and the at least one auxiliary thruster include a propeller and are operated by at least one electric motor inside the hull.

3. The autonomous, modular, underwater vehicle according to claim 1, wherein the hull is made of non-corrodible composite material.

4. The autonomous, modular, underwater vehicle according to claim 1, wherein the one or more watertight containers are made of titanium and capable of tolerating pressures up to 300 bar.

5. The autonomous, modular, underwater vehicle according to claim 1, wherein the onboard measuring sensors effect measurements of at least one of the following parameters:

- temperature
- electric conductivity,
- saturation concentration and/or percentage of dissolved oxygen,
- turbidity,
- fluorescence, pH,
dissolved gas concentration, and
hydrocarbon concentration.

6. The autonomous, modular, underwater vehicle according to claim 1, wherein the onboard measuring sensors positioned inside the hull communicate with a sea environment by at least one opening present on the hull.

7. The autonomous, modular, underwater vehicle according to claim 1, wherein the vehicle comprises circuitry configured to allow a bidirectional exchange of information for synchronizing data collected by the onboard measuring sensors and the at least one measuring sensor.

8. The autonomous, modular, underwater vehicle according to claim 1, wherein the hull has a flattened form with a flat lower surface to facilitate resting of the vehicle on the underwater station or on the seabed.

9. The autonomous, modular, underwater vehicle according to claim 1, wherein the at least one external instrumental module equipped with the at least one measuring sensor comprises:

circuitry configured to allow synchronization of a measurement effected by the at least one measuring sensor with measurements effected by the onboard measuring sensors, a hull, and circuitry configured to control functioning of the at least one measuring sensor, regulation and distribution of the energy feed, and interface with the vehicle.

10. The autonomous, modular, underwater vehicle according to claim 9, wherein the at least one external instrumental module further comprises at least an inner energy source.

11. The autonomous, modular, underwater vehicle according to claim 9, wherein the circuitry configured to control the functioning and the battery are contained in at least one watertight container made of titanium, positioned inside the hull.

12. The autonomous, modular, underwater vehicle according to claim 10, wherein the hull is made of composite material or another material.

13. The autonomous, modular, underwater vehicle according to claim 1, wherein the at least one measuring sensor installed in the at least one external instrumental module is selected from following types of sensors:

optical,
acoustic,
automatic hydrocarbon analyzer,
automatic phenol analyzer,
automatic trace metal analyzer, and
automatic nutrient analyzer.

14. The autonomous, modular, underwater vehicle according to claim 1, wherein the at least one external instrumental module is detachable from the vehicle such that the at least one external instrumental module can be stored at the underwater station.

15. An autonomous modular underwater vehicle including onboard measuring sensors, comprising:

at least one main thruster;

at least one auxiliary thruster for fine positioning;

a hull;

at least one battery;

circuitry configured to interface with an interface for exchanging communications between the vehicle and an underwater station allowing the recharging of the at least one battery;

at least one electronic control module implemented by circuitry and configured to manage propulsion, sensors, and power;

at least one external instrumental module, wherein the at least one external instrumental module includes:

at least one measuring sensor;

at least one controller; and at least one instrumental module battery; and an electromechanically activated attaching coupler which allows attachment of the at least one external instrumental module to the underwater vehicle by hooking in which a coupling member of the electromechanically activated attaching coupler passes through a connection tab provided on the at least one external instrumental module.

16. The autonomous, modular, underwater vehicle according to claim 15, wherein the at least one controller and the at least one instrumental module battery of the at least one external instrumental module are contained in a watertight container.

* * * * *